US005365887A

United States Patent [19]

Fenn

[11] Patent Number: 5,365,887

[45] Date of Patent: Nov. 22, 1994

[54] ULTRA-HIGH EFFICIENCY ON-DEMAND WATER HEATER AND HEAT EXCHANGER

[75] Inventor: Gordon W. Fenn, Dundee, Mich.

[73] Assignee: Frontier, Inc., Ann Arbor, Mich.

[21] Appl. No.: 874,649

[22] Filed: Apr. 27, 1992

[51] Int. Cl.[5] ..... F22B 5/00

[52] U.S. Cl. ..... 122/16; 122/44.2; 122/155.2; 122/367.1; 165/177; 165/179

[58] Field of Search ..... 122/16, 13.1, 53, 367.1, 122/367.3; 165/177, 179, 154, 160, 181; 122/44.2, 155.2

[56] References Cited

U.S. PATENT DOCUMENTS

| | | | |
|---|---|---|---|
| 1,935,919 | 11/1933 | Ronstrom | 122/131 X |
| 2,622,853 | 12/1952 | Becker | 122/131 X |
| 3,170,511 | 2/1965 | Guthrie | 165/154 X |
| 3,829,285 | 8/1974 | Beck | 165/154 X |
| 4,096,910 | 6/1978 | Coffinberry et al. | 165/154 X |
| 4,395,976 | 8/1983 | de Lallee et al. | 122/367.3 |
| 4,419,802 | 12/1983 | Riese | 165/179 X |

FOREIGN PATENT DOCUMENTS

| | | | |
|---|---|---|---|
| 355345 | 8/1931 | United Kingdom | 122/155.2 |
| 370588 | 4/1932 | United Kingdom | 122/155.2 |

*Primary Examiner*—Edward G. Favors

[57] ABSTRACT

The heat exchange structure comprises a series of tubes arranged in a circular pattern extending between upper and lower manifolds. Water flows from the upper manifold through these tubes to the lower manifold. Annular fins are stacked on these tubes. A larger tube is arranged concentric with each of the smaller diameter water-carrying tubes and hot gaseous products of combustion flow through these larger tubes in counterflow to the water flow through the water tubes. The fins have through-holes allowing the hot gases to pass through the stacks of fins. The combustion chamber is located centrally just above the lower manifold. Ambient air is introduced via perforations in the side wall of the casing near the upper manifold and flows downwardly past the heat exchange structure for recuperative effect before reaching the combustion chamber.

16 Claims, 3 Drawing Sheets

ULTRA-HIGH EFFICIENCY ON-DEMAND WATER HEATER AND HEAT EXCHANGER

FIELD OF THE INVENTION

This invention relates to gas-fired hot water heaters and to heat exchangers.

BACKGROUND AND SUMMARY OF THE INVENTION

Typical gas-fired domestic and light commercial water heaters comprise a tank in which water is heated and stored. The burner is controlled by a thermostat that strives to maintain a set temperature for the water. Examples of energy conservation measures that have been adopted by the manufacturers of these appliances in order to improve their efficiency include better thermal insulation of the tank and electronic ignition for the burner. In the United States there has been little fundamental change however in the basic concept of such a water heater: it still comprises a tank in which heated water is stored ready for use.

An on-demand gas-fired water heater would be a distinct improvement from the standpoint of energy conservation because it would have no such reservoir from which heat is wastefully dissipated to the surroundings. But an essential requirement for a commercially viable appliance of this type is that it be manufacturable at a price that is reasonably competitive in the marketplace, taking into account its improved efficiency. A further requirement is that it not occupy any significantly larger amount of space than do present commercial water heaters of equivalent hot water delivery ratings, and preferably that it occupy less space.

A preliminary novelty search conducted in connection with the present invention developed U.S. Pat. Nos. 4,909,191; 1,582,230; 4,453,496; 4,867,106; 4,401,058; 4,366,778; 4,096,616; 4,825,813; and 2,537,984.

U.S. Pat. Nos. 4,453,496 and 4,825,813 describe what are designated "once-through type boilers". Such a boiler comprises an upright cylindrical enclosure whose interior contains a heat exchanger in the form of an annular lower manifold, an annular upper manifold, and a number of tubes arranged in a circular pattern and extending between the two manifolds. Cold water is introduced into one of the manifolds, passes through the tubes to the other manifold, and is discharged from the latter manifold. A gas burner is disposed within the center of the lower manifold and the hot products of combustion pass over the exteriors of the tubes, heating the water in the process. In order to improve the efficiency of the heat exchanger, fins are disposed on the exteriors of the tubes.

The general concept of mounting fins on a tube by stacking individual fin elements on the outside of a tube is not novel. The concept is shown by U.S. Pat. No. 2,537,984.

U.S. Pat. No. 4,909,191 discloses a hot water appliance having a heat exchanger that is in certain respects similar to those of U.S. Pat. Nos. 4,453,496 and 4,825,813. Each of its tubes that extends between its manifolds is actually a "tube-within-a tube", one of which carries "sanitary" water and the other of which carries "radiator" water. The side of the heat exchanger is enclosed by a cylindrical wall that is spaced inwardly from the casing's side wall to define an annular cylindrical space surrounding the heat exchanger. Combustion air flows through this space before reaching the gas burner, which interestingly is disposed within the center of the upper manifold.

U.S. Pat. Nos. 1,582,230; 4,401,058; and 4,366,778 show other forms of water heaters having similar heat exchangers.

U.S. Pat. No. 4,096,616 discloses a heat exchanger comprising concentric tubes with inserted fins, and U.S. Pat. No. 4,867,106 discloses a hot water heater in which the combustion gases flow flow through a helical path that is formed by a helical insert disposed within a tube.

The present invention relates to a new and unique on-demand gas-fired water heater and heat exchanger which exhibit ultra-high efficiency in a relatively compact volume and which can be manufactured using known technology to be competitively priced with available appliances, taking into account the energy savings that are obtainable with the present invention due to its improved energy efficiency. Appliances embodying principles of the present invention are well-suited for mass-production fabrication in various model sizes.

The distinguishing features of the present invention and its many attributes will be seen in the ensuing detailed description of a presently preferred embodiment that represents the best mode contemplated at the present time in carrying out the invention. Drawings accompany the disclosure and are briefly described as follows.

DESCRIPTION OF THE PREFERRED EMBODIMENT

Figure 2:
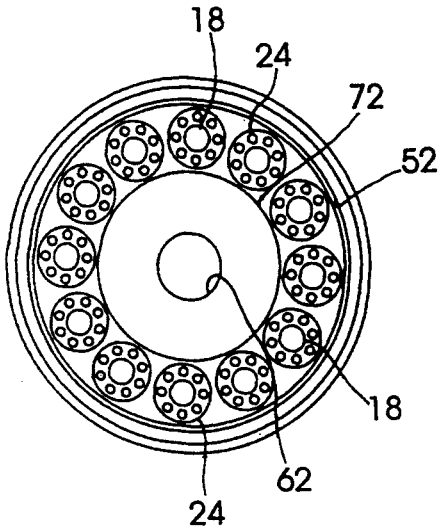
FIG. 2 is a transverse cross sectional view in the direction of arrows 2—2 in FIG. 1, but with certain portions omitted in the interest of clarity.
Figure 1:
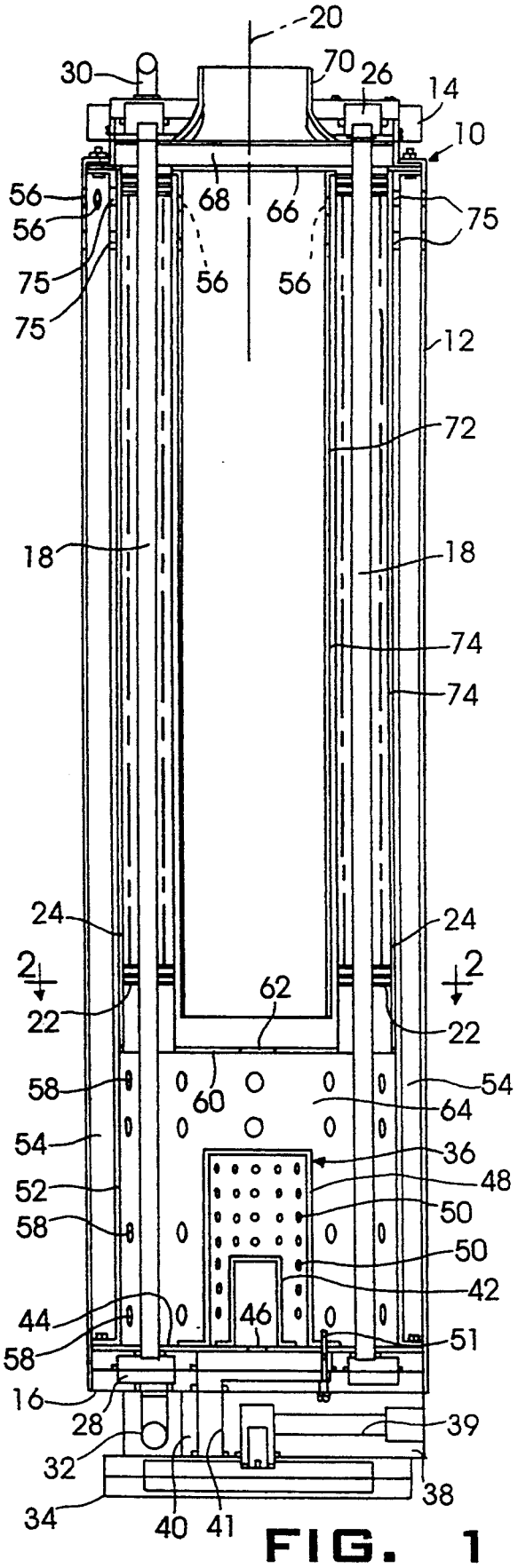
FIG. 1 is a longitudinal cross sectional view through a water heater embodying principles of the present invention.

The drawing Figs. illustrate a water heater 10 according to the present invention. It comprises a cylindrical casing 12 having a cold water manifold 14 at the top and a hot water manifold 16 near the bottom. A series of circular cylindrical tubes 18 are arranged in a uniform circular pattern around the main longitudinal axis 20 of water heater 10 and extend between manifolds 14 and 16 parallel with axis 20. Stacked onto a certain section of each tube 18 are a series of fin elements 22, depicted in greater detail in FIGS. 3 and 4. Each tube 18 and its fin elements 22 form a sub-assembly that is disposed concentrically within a corresponding larger circular cylindrical tube 24. It is the combination of tubes 18, fins 22, and tubes 24 that constitute the basic heat exchanger structure which is arranged concentric with axis 20. Further heater exchanger structure is formed by the combination of this basic heat exchanger structure with additional structure, such as manifolds 14 and 16, and further structure to be hereinafter described.

The construction of each manifold 14, 16 is similar in that it comprises a generally circular body having a corresponding circular annular manifold space 26, 28 within its interior. The upper ends of tubes 18 are disposed in common communication with manifold space 26 while their lower ends are in common communication with manifold space 28. A cold water inlet pipe 30 comprising an elbow enters manifold space 26 via the face of manifold 14 that is opposite the face through which tubes 18 enter. A hot water outlet pipe 32 also comprising an elbow enters manifold space 28 via the face of manifold 16 that is opposite the face through which tubes 18 enter. When the water heater is in use, cold water enters manifold space 26 via inlet pipe 30, and is distributed around the manifold. It then passes in parallel paths through the individual tubes 18 (where it is heated in a manner to be subsequently described) to manifold space 28 from whence it leaves the water heater via outlet pipe 32 as hot water.

Below pipe 32, at the very bottom of the water heater, is a flow control valve 34 for regulating the flow of combustion gas to a burner 36 that is disposed on the top face of manifold 16 concentric with axis 20. A combustion gas inlet conduit member 38 which is disposed between valve 34 and manifold 16 comprises a gas inlet passageway 39 that serves to convey combustion gas from a supply (not shown) to the inlet of flow control valve 34. A combustion gas outlet conduit member 40 comprises a gas outlet passageway 41 that extends from the flow control valve's outlet to the burner's inlet.

Burner 36 comprises a short inner tube 42 that is supported upright on a plate 44 that overlies the upper face of manifold 16. Tube 42 is concentric with axis 20, and its upper end is open. There is a circular hole 46 in plate 44 through which combustion gas from flow control valve 34 enters the interior of tube 42.

Tube 42 is surrounded by a flame holder 48 in the form of a larger tube that that is also uprightly supported on plate 44 concentric with axis 20. The upper end of tube 48 is closed, but it has a pattern of perforations 50 in its side wall. An igniter 51 is mounted on the burner adjacent the lower outside of flame holder 48.

Supported uprightly on the outer margin of plate 44 is a circular cylindrical wall 52 that is concentric with, and of somewhat smaller diameter than, casing 12. The height of wall 52 is coextensive with almost the entire height of casing 12 so that the two cooperatively form an annular space 54 on the interior of the casing. A pattern of perforations 56 is provided near the top of casing 12, and they form the combustion air inlet via which combustion air from the surrounding environment enters water heater 10. A pattern of perforations 58 is provided near the bottom of wall 52, below the level of a circular plate 60 that is disposed transverse to axis 20 within wall 52 at the level of the lower ends of tubes 24. Plate 60 is fitted to the interior of wall 52 and has a pattern of circular holes within which the lower ends of tubes 24 are received; it also has a central circular hole 62. Thus, perforations 58 lie within that portion of wall 52 which is axially between plates 44 and 60 and which, in cooperation with these two plates, bounds a combustion space 64, and the portions of tubes 18 that protrude downwardly from tubes 24 extend through this combustion space to manifold 16, passing through clearance holes in plate 44 in the process.

A further circular plate 66 extends transversely across the interior casing 12 near the top, and has a pattern of circular holes within which the upper ends of tubes 24 are received. Those portions of tubes 18 that protrude upwardly from tubes 24 extend through a circular space 68 that lies immediately above plate 66 and below manifold 14. A short exhaust pipe 70 passes centrally through the open center of manifold 14 and serves to funnel space 68 to an exhaust duct (not shown) to which the upper end of pipe 70 is fitted.

Extending downwardly from plate 66 concentric with axis 20 in slightly inwardly spaced relation to the radially innermost portion of each tube 24 is a tube 72. Tube 72 extends downwardly for most of the length of tubes 24, but stops short of plate 60. Although the lower end of tube 72 is open, the tube does not constitute a through-passage because its upper end is closed by the central region of plate 66. Tube 72 cooperates with wall 52 in defining a circular annular space 74 within which most of the length of tubes 24 extending from plate 66 are disposed. A pattern of perforations 75 is provided in the upper portion of wall 52 so that the upper end of space 74 is in communication with the upper end of space 52. In this way space 74 provides a path for combustion air that parallels the flow path through space 52.

Figure 4:
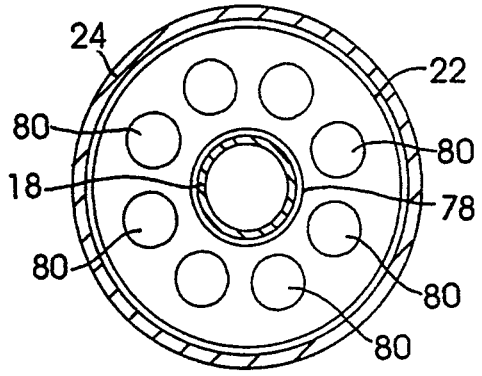
FIG. 4 is a transverse cross sectional view in the direction of arrows 4—4 in FIG. 3.
Figure 5:
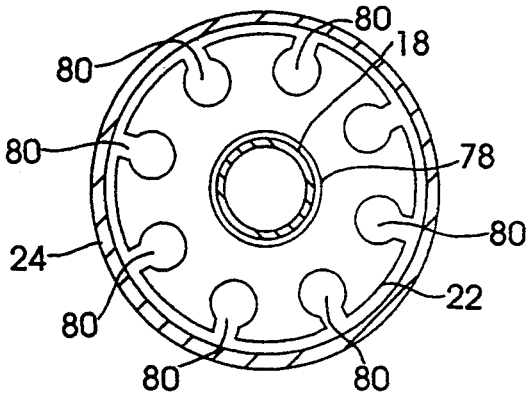
FIG. 5 is a view in the same direction as that of FIG. 4, but illustrating a modified form.
Figure 3:
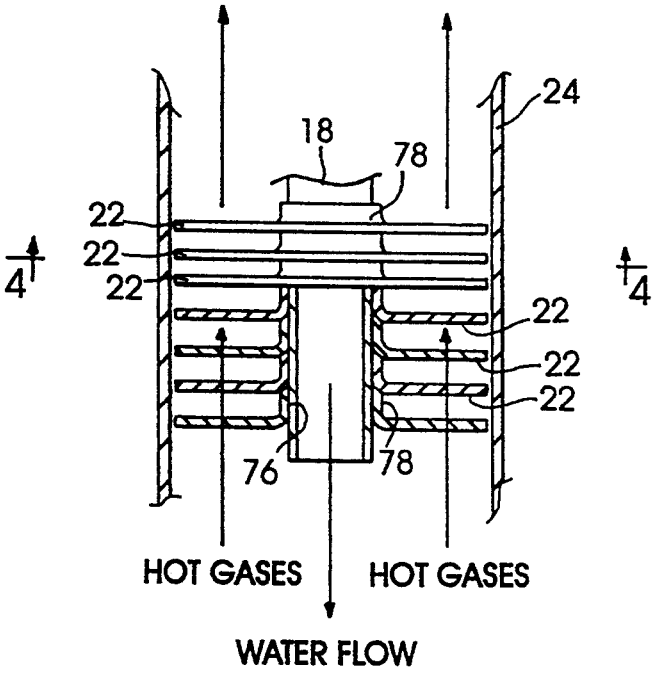
FIG. 3 is a longitudinal view of a portion of the heat exchanger structure by itself.

FIGS. 3 and 4 present details of fin elements 22 and their relationship with tubes 18 and 24. Each fin element has a circular shape and comprises a central circular hole 76 having a flange 78. The fins elements are stacked onto tube 18 with flanges 78 serving to provide both a press-fit onto the tube and an abutment with an immediately adjacent fin element. In this way the transverse extents of the fin elements are accurately axially spaced at uniform spacing distances along the length of the tube, and they are in good thermal conductive relationship with the tube. The transverse portions of the fin elements comprise a number of through-holes 80. The pattern of holes 80 in FIG. 4 represents one pattern wherein the holes are circular and arranged in a uniform pattern. The pattern shown in FIG. 5 is an alternate construction wherein the holes are in the form of notches formed in the outer margin of the fin element. When the fin elements are stacked onto a tube they may be arranged such that they are in circumferential registry, or alternatively circumferentially staggered. Stagger will tend to create a somewhat more tortuous path than will registry.

Figure 6:
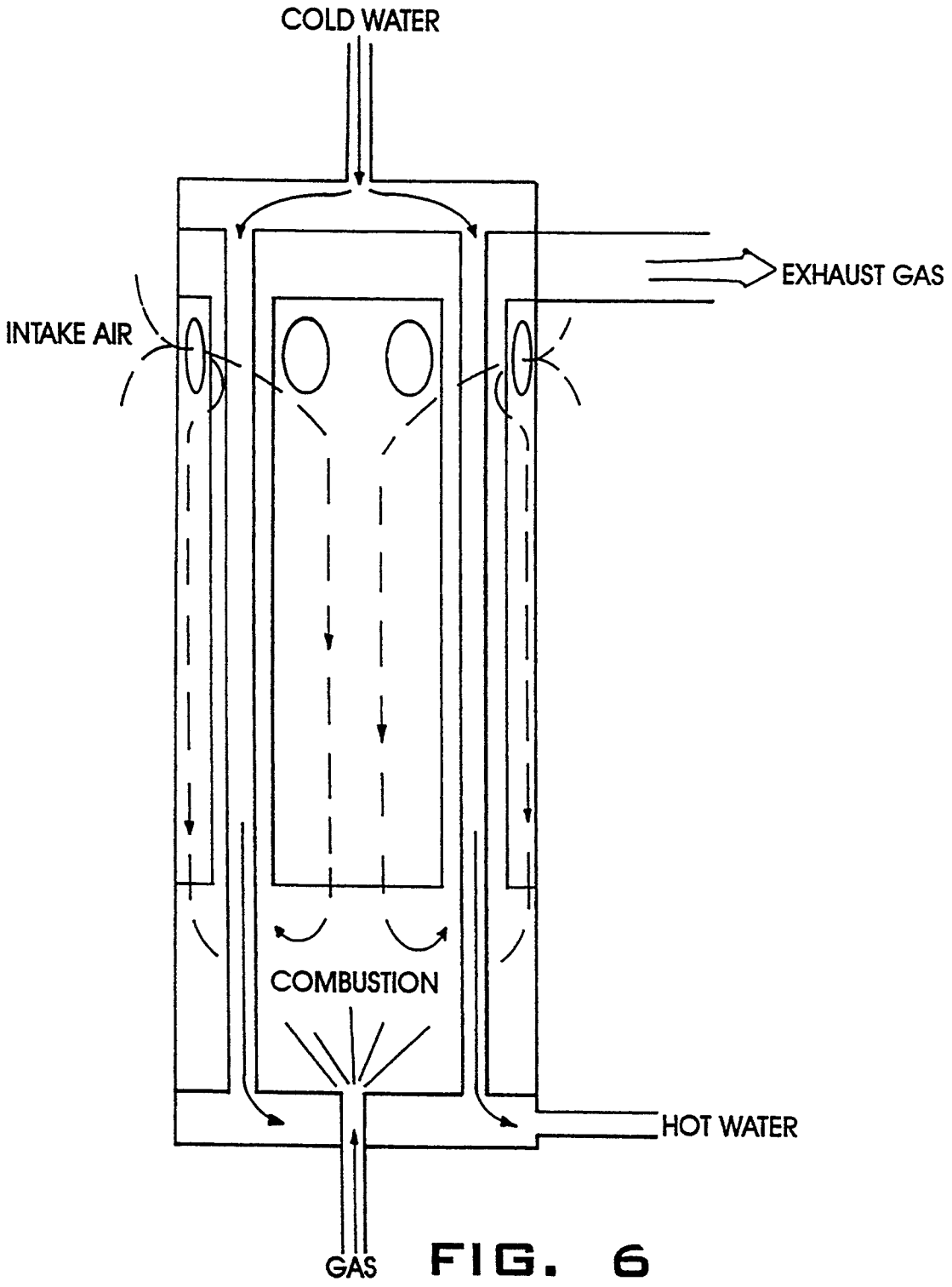
FIG. 6 is a view like that of FIG. 1, but of a somewhat schematic nature, illustrating operation of the water heater.

Having therefore described the construction of water heater 10, it is now appropriate to describe its operation. As an aid the reader may wish to refer to FIG. 6 which portrays the flows with the help of arrows. When hot water is demanded, flow control valve 34 is opened in an appropriate amount to allow a corresponding gas flow to burner 36. Igniter 51 is operated to ignite a combustible gas/air mixture formed in combustion space 64 surrounding burner 36. This gas/air mixture consists of gas that has been emitted from the burner and air that has entered the water heater via perforations 56, and then passed downwardly through the parallel flow paths provided by spaces 54 and 74. The air flow through space 54 passes laterally through perforations 58 to enter space 64 in a generally radially inwardly direction. The air flow through space 74 enters space 64 via hole 62 in a generally axially downwardly direction. The hot products of combustion enter tubes 24 and pass upwardly through the holes 80 in fin elements 22. They exit tubes 24 to space 68 and pass from water heater 10 via pipe 70.

At the same time that the hot gases are flowing upwardly through tubes 24, cold water is flowing downwardly through tubes 18. This concentric counterflow of the two fluids creates a highly efficient transfer of heat from the hot gases to the water with the result that by the time that the water has completed the downward transit through tubes 18, it has been heated to a desired temperature.

The control system contains suitable sensors for measuring various parameters associated with the water flow and control electronics responsive to said sensors for adjusting flow control valve 34 such that the energy input to burner 36 is regulated to produce a desired temperature for hot water delivered via outlet pipe 32. Thus, an on-demand ultra-high efficiency water heater is provided in a relatively compact package well-suited for domestic and light commercial and industrial usage. It is to be appreciated however that the configurations for the water heater and heat exchanger disclosed in this patent application are useful by themselves without necessarily being associated with any particular control system.

A number of features contribute to the efficiency of the water heater. One of course is the heat exchanger structure that has been described in detail. Another is the air circuit via which ambient air, such as room air, enters water heater 10, travels axially downwardly, passing the heat exchanger structure in the process; this produces a certain recuperative pre-heating of the combustion air while also in the case of space 54 providing a thermal barrier to heat loss through the side wall of casing 12. Still another feature is the arrangement of combustion chamber space 64 and burner 36, especially the manner in which the gas and air are mixed and combusted in combustion space 64 and then passed through the heat exchanger and exhausted.

Conventional material are used in the fabrication of the water heater; for example, stainless steel is used in the heat exchange structure. Conventional constructional details are also employed, such as the use of suitable seals and fastening means at various joints. Likewise conventional engineering calculations are used to determine the sizes and dimensional details of various parts to achieve a desired capacity for the water heater. The use of a pump connected to pipe 70 may be advantageously used to draw the combustion air and hot gases through the water heater.

The inventive principles may be advantageously employed to provide water heaters of different sizes and capacities. For example, common manifolds 14, 16 may be used for models that differ in the lengths of tubes 18. Also, larger capacity, modular water heaters may be constructed from two or more individual units 10 connected in parallel with economies resulting from the fact that a single control system can be employed, rather than each unit having its own control system.

Having therefore described a presently preferred embodiment of the invention, which is nonetheless susceptible to various modifications without departing from the principles of the invention, what is claimed is:

1. Heat exchanger structure comprising plural concentric tube pairs arranged in parallel, each pair comprising an inner tube of good thermal conductivity that is arranged concentrically within an outer tube of good thermal conductivity, means providing for a first fluid to flow through said inner tubes in a given direction, means providing for a second fluid to flow through said outer tubes in counterflow to the flow of said first fluid through said inner tubes, and plural annular fin elements of good thermal conductivity stacked onto the exterior of each said inner tube and disposed within the corresponding said second tube transverse to the flow of said second fluid, said fin elements comprising through-holes providing for passage of said second fluid through each fin element, in which the fin elements on each inner tube have an axially extending flange that embraces the inner tube and also abuts an immediately adjacent fin element.

2. Heat exchanger structure as set forth in claim 1 in which said through-holes in each of said fin elements are a pattern of circular holes that are spaced radially from radially inner and radially outer edges of the fin element.

3. Heat exchanger structure as set forth in claim 1 in which said through-holes in each of said fin elements are a pattern of notches in the radially outer margin of the fin element.

4. Heat exchanger structure as set forth in claim 1 in which first ends of said inner tubes are disposed in communication with a first manifold, and second ends of said inner tubes are in communication with a second manifold, said manifolds comprise annular manifold spaces, and said first pairs are arranged in a circular configuration.

5. Gas-fired heater and heat exchanger structure wherein said heat exchanger structure is disposed on the interior of a casing of said gas-fired heater, said heat exchanger structure comprising plural concentric tube pairs arranged in parallel, each pair comprising an inner tube of good thermal conductivity that is arranged concentrically within an outer tube of good thermal conductivity, means providing for a first fluid to flow through said inner tubes in a given direction, means providing for a second fluid to flow through said outer tubes in counterflow to the flow of said first fluid through said inner tubes, and plural annular fin elements of good thermal conductivity stacked onto the exterior of each said inner tube and disposed within the corresponding said outer tube transverse to the flow of said second fluid, said fin elements comprising through-holes providing for passage of said second fluid through each fin element, said first fluid being water, and said second fluid comprising hot gases that are products of combustion of a gaseous fuel that is combusted with an oxidant within the interior of said casing of the heater, and first ends of said inner tubes being disposed in communication with a first manifold, and second ends of said inner tubes being disposed in communication with a second manifold, said manifolds comprising annular manifold spaces, and said tube pairs are arranged in a circular configuration.

6. Gas-fired heater and heat exchanger structure as set forth in claim 5 wherein said casing is a cylindrical casing circumferentially bounding said tube pairs, the oxidant is air that is introduced into the heater proximate said first manifold via an air inlet in said casing proximate said first manifold, passes axially through air passageway structure within said casing in the direction toward said second manifold, and mixes with gas emitted from a burner that is proximate said second manifold to form the combustible mixture.

7. Gas-fired heater and heat exchanger structure as set forth in claim 6 wherein the heater has a combustion space disposed axially between said second manifold and ends of said outer tubes that are toward said second manifold, combustion takes place in said combustion space, and the products of combustion pass from said combustion space to enter said outer tubes.

8. Gas-fired heater and heat exchanger structure as set forth in claim 6 in which said air passageway structure comprises two parallel paths, one of said paths being an annular passageway space disposed between said casing and a cylindrical wall disposed between said tube pairs and said casing, and the other of said paths being a passageway space that is interior of said tube pairs.

9. Gas-fired heater and heat exchanger structure as set forth in claim 8 in which said other of said paths is annular in shape.

10. Gas-fired heater and heat exchanger structure as set forth in claim 6 in which said burner comprises a flame holder tube that extends axially away from said second manifold, that has a first axial end which is open toward said second manifold and through which gas to be combusted enters the interior of said of said flame holder tube, that has a second axial end opposite its first axial that is closed, and that has a pattern of perforations in its side wall through which gas passes to a combustion space where it mixes with air and is combusted.

11. Gas-fired heater and heat exchanger structure as set forth in claim 10 including a tube that is smaller in diameter than said flame holder tube and penetrates through the first end of said flame holder tube, that conducts gas to be combusted into the interior of said flame holder tube, and that terminates approximately half-way along the length of said flame holder tube so as to introduce gas into said flame holder tube at a location approximately half-way along the length of said flame holder tube and the pattern of perforations in the side wall of said flame holder tube.

12. A gas-fired heater comprising a cylindrical casing circumferentially bounding a heat exchanger structure, said heat exchanger structure comprising plural concentric tube pairs arranged in parallel, each pair comprising an inner tube of good thermal conductivity that is arranged concentrically within an outer tube of good thermal conductivity, first ends of said inner tubes being disposed in communication with a first manifold, and second ends of said inner tubes being disposed in communication with a second manifold, said manifolds comprising annular manifold spaces, said tube pairs being arranged in a circular configuration, means providing for a liquid to be heated to flow from said first manifold space through said inner tubes to said second manifold space, means providing for a hot gas to flow through said outer tubes, plural annular fin elements of good thermal conductivity stacked onto the exterior of each said inner tube and disposed within the corresponding said outer tube transverse to the flow of said hot gas, said fin elements comprising through-holes providing for passage of said hot gas through each fin element, a combustion space disposed axially between said second manifold and ends of said outer tubes that are toward said second manifold, combustion taking place in said combustion space via a burner at said combustion space to generate said hot gas in said combustion space, and the hot gas passing from said combustion space to enter said outer tubes, and air passageway structure extending from a location proximate said first manifold to said combustion space.

13. A gas-fired heater as set forth in claim 12 in which said air passageway structure comprises two parallel paths, one of said paths being an annular passageway space disposed between said casing and a cylindrical wall disposed between said tube pairs and said casing, and the other of said paths being a passageway space that is interior of said tube pairs.

14. A gas-fired heater and heat exchanger structure as set forth in claim 13 in which said other of said paths is annular in shape.

15. A gas-fired heater and heat exchanger structure as set forth in claim 13 in which said burner comprises a flame holder tube that extends axially away from said second manifold, that has a first axial end which is open toward said second manifold and through which gas to be combusted enters the interior of said flame holder tube, that has a second axial end opposite its first axial that is closed, and that has a pattern of perforations in its side wall through which gas passes to a combustion space where it mixes with air and is combusted.

16. Gas-fired heater and heat exchanger structure as set forth in claim 15 including a tube that is smaller in diameter than said flame holder tube and penetrates through the first end of said flame holder tube, that conducts gas to be combusted into the interior of said flame holder tube, and that terminates approximately half-way along the length of said flame holder tube so as to introduce gas into said flame holder tube at a location approximately half-way along the length of said flame holder tube and the pattern of perforations in the side wall of said flame holder tube.

* * * * *